US005285651A

United States Patent [19]

Marine

[11] Patent Number: 5,285,651

[45] Date of Patent: Feb. 15, 1994

[54] AIR CONDITIONER COOLING APPARATUS

[76] Inventor: Robert W. Marine, P.O. Box 41, Seaford, Del. 19973-0041

[21] Appl. No.: 88,380

[22] Filed: Jul. 9, 1993

[51] Int. Cl.[5] ..... F28D 3/00
[52] U.S. Cl. ..... 62/171; 62/305
[58] Field of Search ..... 62/171, 305, 121; 126/113

[56] References Cited

U.S. PATENT DOCUMENTS 4,274,266 6/1981 Shires ..... 62/171
4,542,627 9/1985 Welker ..... 62/171

*Primary Examiner*—William E. Wayner
*Attorney, Agent, or Firm*—Leon Gilden

[57] ABSTRACT

An air conditioner housing employs a fluid manifold operative through a support rod and lift cup to effect fluid flow through an associated fluid valve into the manifold to effect fogging mist of the fluid to be directed upon the condenser coils to enhance cooling efficiency of the air conditioner unit in use.

4 Claims, 5 Drawing Sheets

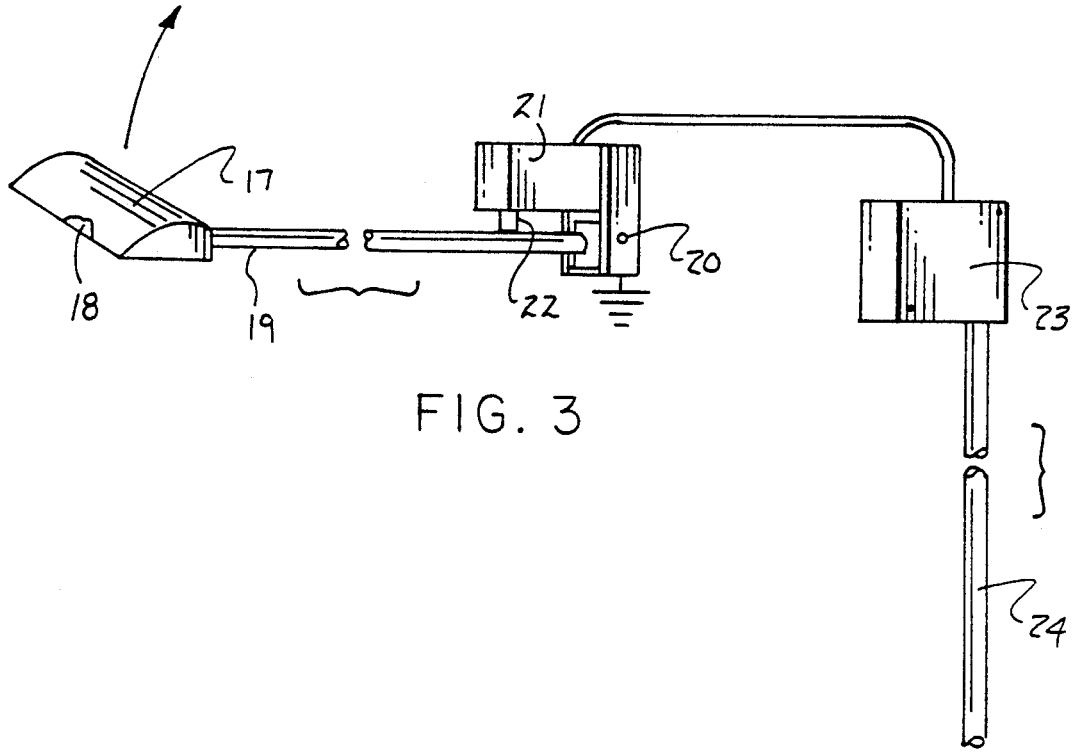
FIG. 3
FIG. 4
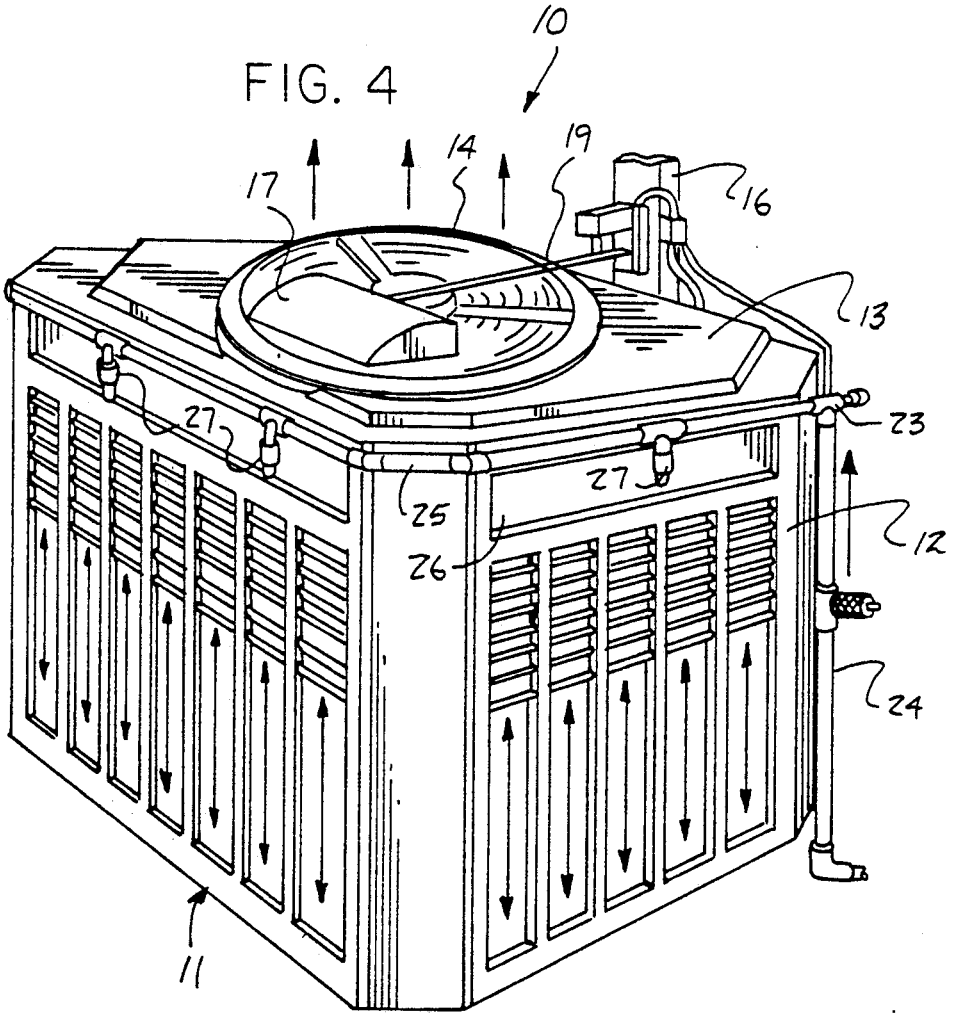

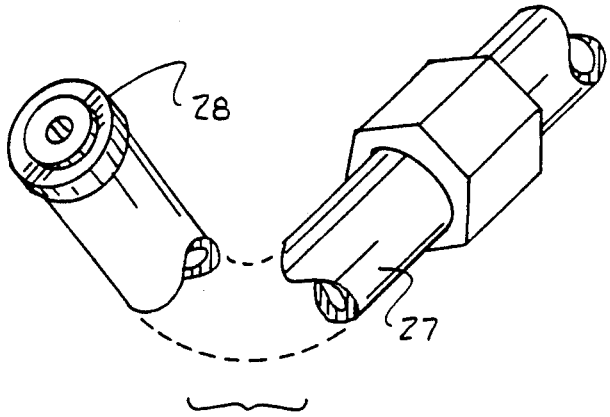
FIG. 5
FIG. 6
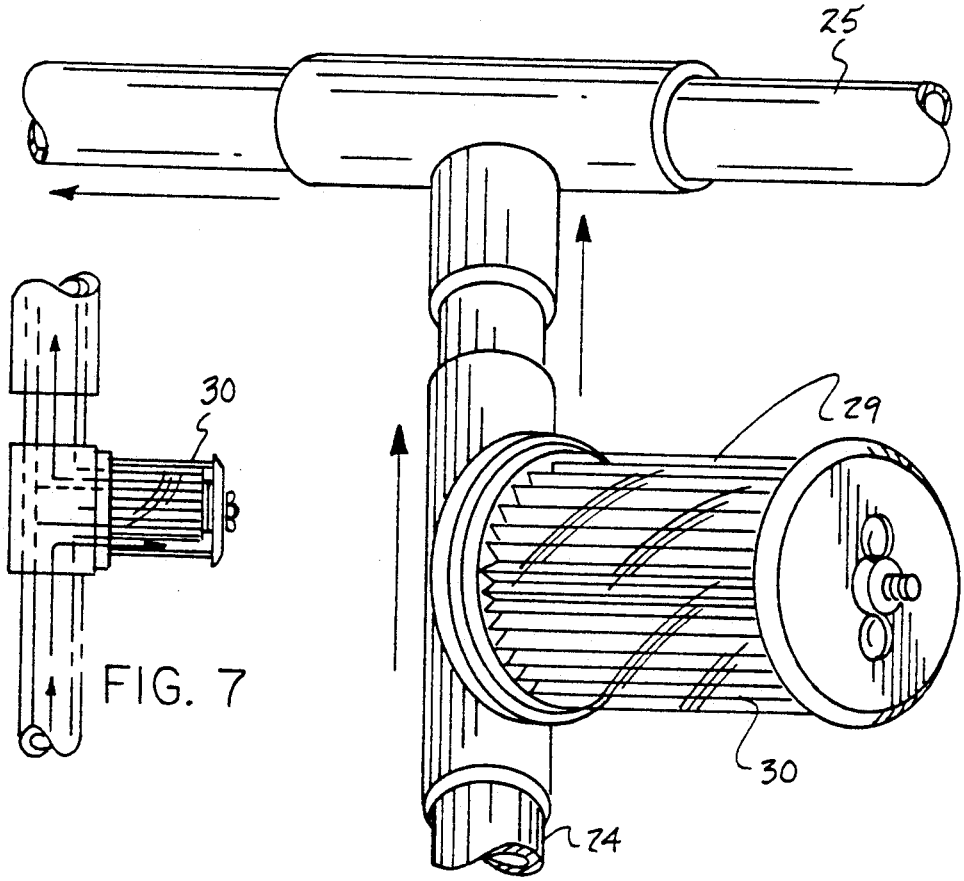
FIG. 7

AIR CONDITIONER COOLING APPARATUS

BACKGROUND OF THE INVENTION

1. Field of the Invention

The field of invention relates to air conditioner apparatus, and more particularly pertains to a new and improved air conditioner cooling apparatus wherein the same is directed to the enhanced efficient operation of an air conditioner by the water cooling of the air conditioner coils.

2. Description of the Prior Art

Air conditioner apparatus of various types have been utilized in the prior art such as indicated in U.S. Pat. No. 5,003,789 indicating a pre-cooling of air entering the air conditioner unit for precooling ambient air prior to its entering the evaporative cooler.

U.S. Pat. No. 4,974,422 to Koch sets forth an air conditioner unit having water fogging nozzles within the air conditioner unit in adjacency to the coils, wherein the nozzles are arranged to direct a mist to the coil or condenser unit of the air conditioner unit.

The instant invention attempts to overcome deficiencies of the prior art, as indicated in U.S. Pat. No. 4,974,422, to provide for an effective and efficient manner for effecting selective operation of the misting nozzles and in this respect, the present invention substantially fulfills this need.

SUMMARY OF THE INVENTION

In view of the foregoing disadvantages inherent in the known types of air conditioner cooling apparatus now present in the prior art, the present invention provides an air conditioner cooling apparatus employing a fluid valve to provide for selective spraying of an air conditioner condenser to enhance efficient operation of air conditioner usage. As such, the general purpose of the present invention, which will be described subsequently in greater detail, is to provide a new and improved air conditioner cooling apparatus which has all the advantages of the prior art air conditioner cooling apparatus and none of the disadvantages.

To attain this, the present invention provides an air conditioner housing employing a fluid manifold operative through a support rod and lift cup to effect fluid flow through an associated fluid valve into the manifold to effect fogging mist of the fluid to be directed upon the condenser coils to enhance cooling efficiency of the air conditioner unit in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved air conditioner cooling apparatus which has all the advantages of the prior art air conditioner cooling apparatus and none of the disadvantages.

It is another object of the present invention to provide a new and improved air conditioner cooling apparatus which may be easily and efficiently manufactured and marketed.

It is a further object of the present invention to provide a new and improved air conditioner cooling apparatus which is of a durable and reliable construction.

An even further object of the present invention is to provide a new and improved air conditioner cooling apparatus which is susceptible of a low cost of manufacture with regard to both materials and labor, and which accordingly is then susceptible of low prices of sale to the consuming public, thereby making such air conditioner cooling apparatus economically available to the buying public.

Still yet another object of the present invention is to provide a new and improved air conditioner cooling apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the operative lift cup employed by the invention and the associated valving in association therewith.

FIG. 4 is an isometric illustration of the invention.

FIG. 5 is an isometric illustration of a nozzle structure of the invention.

FIG. 6 is an isometric illustration of the fluid filter structure employed by the invention.

FIG. 7 is an orthographic side view of the filter structure in operation, as employed by the invention.

DESCRIPTION OF THE PREFERRED EMBODIMENT

Figure 1:
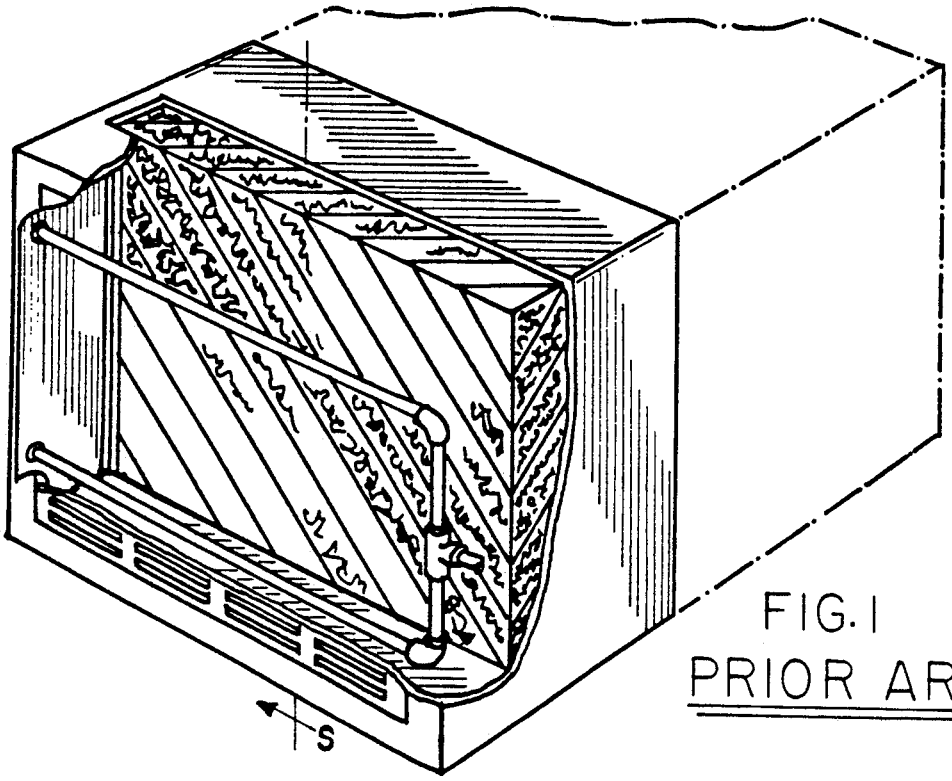
FIG. 1 PRIOR ART
FIG. 1 is an isometric illustration of a prior art air conditioner cooling unit, as indicated in U.S. Pat. No. 5,003,789, to effect pre-cooling of ambient air directed into the evaporative cooler of the air conditioner unit.

With reference now to the drawings, and in particular to FIGS. 1 to 11 thereof, a new and improved air conditioner cooling apparatus embodying the principles and concepts of the present invention and generally designated by the reference numeral 10 will be described.

Figure 2:
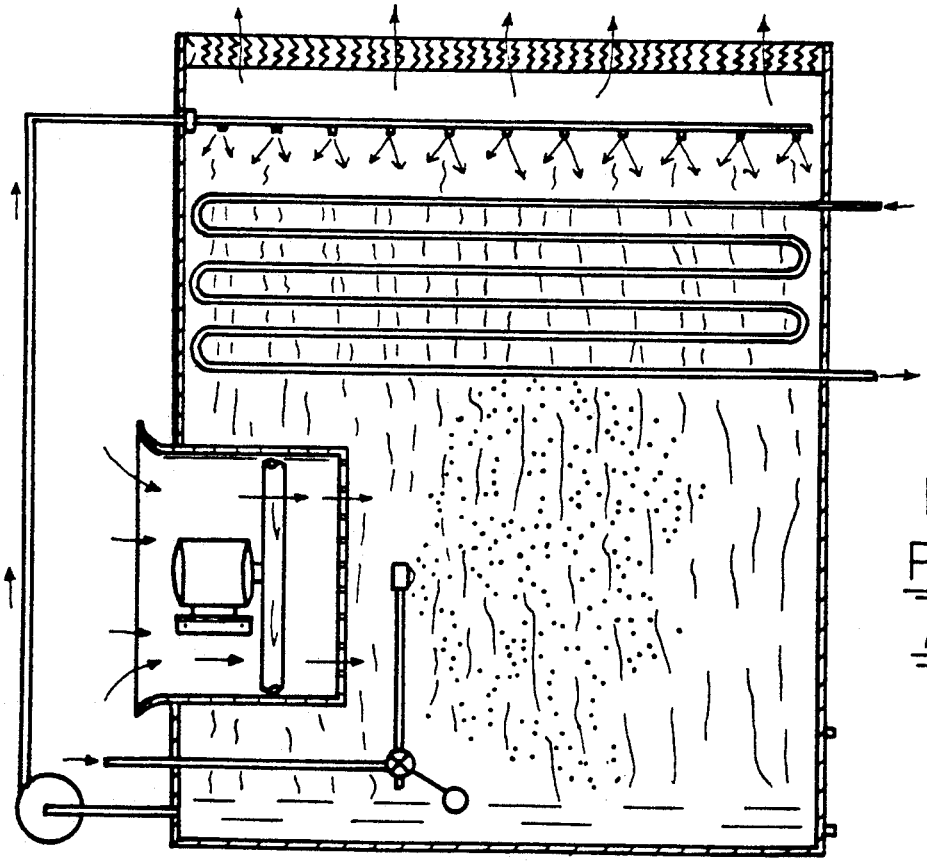
FIG. 2 PRIOR ART
FIG. 2 indicates the U.S. Pat. No. 4,974,422 having misting nozzles positioned in adjacency to the air conditioner condenser coils.

More specifically, the air conditioner cooling apparatus 10 of the instant invention essentially comprises an air conditioner housing 11 having housing side walls 12, including a housing top wall 13, with a top wall exhaust grid 14 mounted within the top wall 13, having a fan 15 (see FIG. 9) positioned within the housing in adjacency to the exhaust grid 14. A support post 16 is mounted to the housing extending thereabove the top wall 13, with the support post mounting a support rod 19 about a pivot axle 20 in operative association to a switch member 21. A support rod 19 extends from the pivot axle 20, with the support rod 19 having a lift cup 17 whose convex cavity 18 is arranged in a facing relationship relative to the exhaust grid 14 oriented between the outer periphery of the exhaust grid and the central orientation of the exhaust grid to provide for enhanced positioning of the convex cavity for maximum lift positioned over one of the impeller blades of the fan 15. The switch member 21 includes a plunger 22 (see FIG. 3) mounted to the support rod 19 in sliding communication therewith, such that upon lifting of the support rod 19 about the pivot axle 20 effects contraction of the plunger 22 into the switch member 21 to effect its operation to effect electrical communication with a fluid control valve 23 to permit its opening and direct fluid flow from the fluid inlet conduit 24 directed into the control valve 23 to an associated manifold conduit 25 mounted along a plurality of the housing side walls 12 to spray the associated air conditioner condenser, in a manner as illustrated in FIG. 2 of the U.S. Pat. No. 4,974,422 incorporated herein by reference. The individual nozzles are provided and typically employ a plurality of such nozzles directed through an individual side wall opening 26 of the housing side wall 12, such that the nozzle conduit 27 includes an outlet end 28 projecting through the side wall openings 26, in a manner as illustrated in FIGS. 4 and 8 for example, to effect spray upon an associated condenser within the housing 11.

The FIG. 7, as well as the FIGS. 4 and 6, illustrate the use of a filter housing 29 mounted to the fluid inlet conduit 24 wherein fluid flow is directed from the fluid inlet conduit 24 through the filter within the filter housing 29 to prevent debris within the nozzle openings and the outlet end 28.

Figure 8:
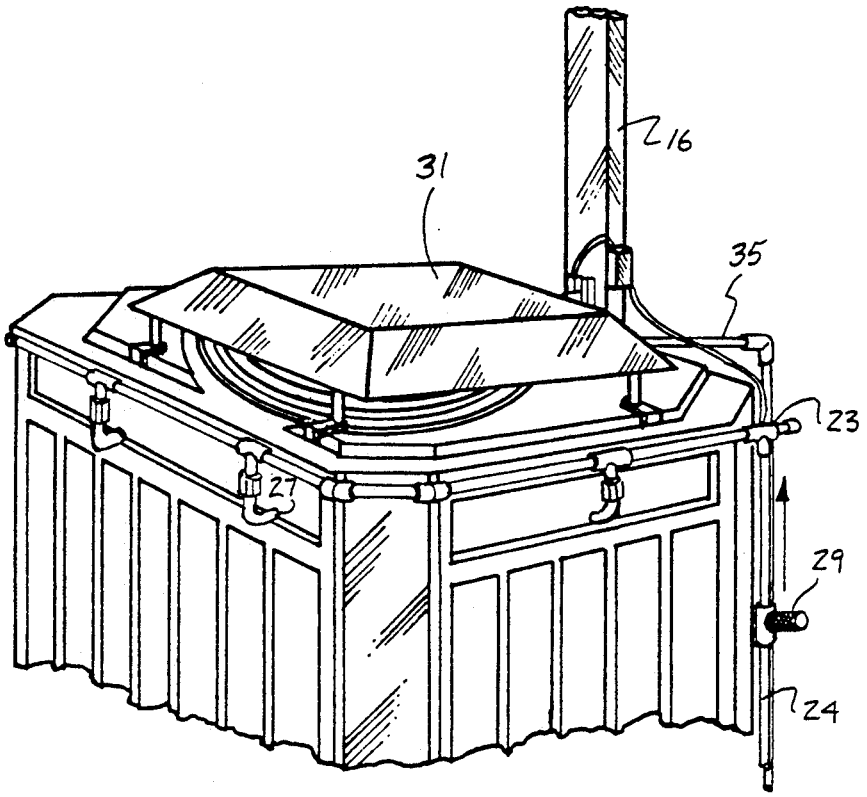
FIG. 8 is an isometric illustration of the invention in using a deflector shield.
Figure 9:
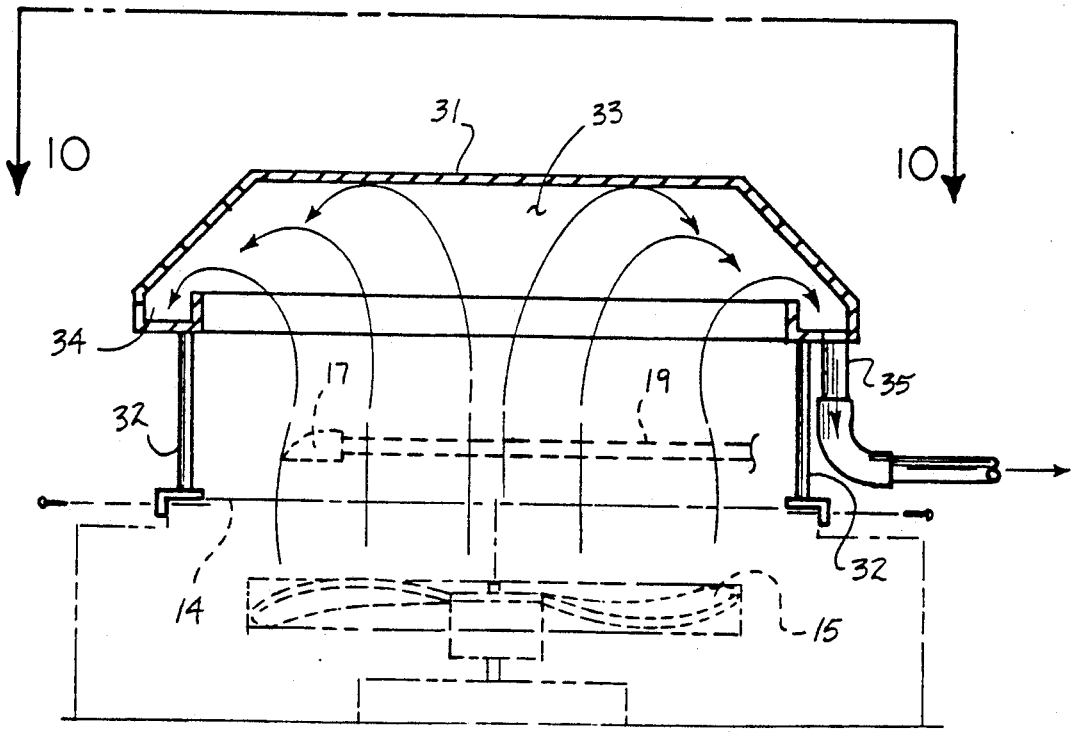
FIG. 9 is an orthographic cross-sectional illustration of a deflector shield mounted to the air conditioner housing.
Figure 10:
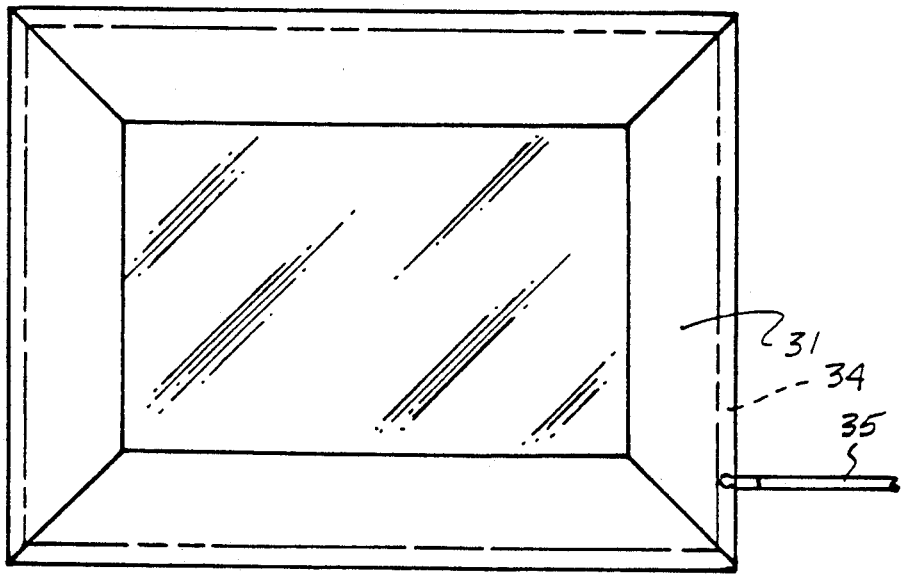
FIG. 10 is an orthographic view, taken along the lines 10—10 of FIG. 9 in the direction indicated by the arrows.
Figure 11:
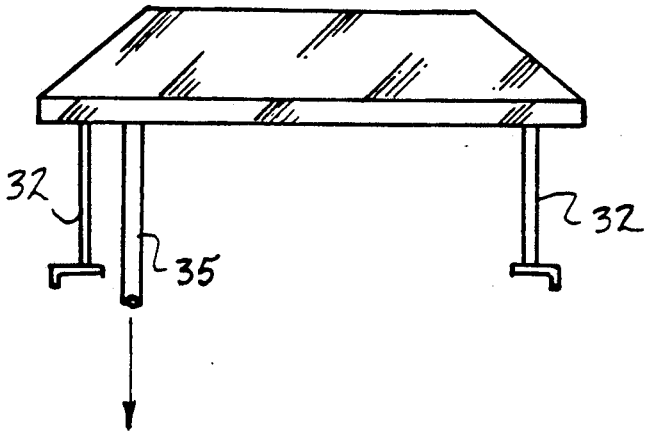
FIG. 11 is an orthographic side view of the shield structure.

The FIGS. 8 and 9 indicate the use of a shield 31 positioned over the grid 14, as well as the support post 16 and the lift cup 17, to prevent rain from impeding ease of lifting of the lift cup 17 in use. It should be understood that the fan 15 functions upon actuation of the condenser in association with the compressor unit of the air conditioner and to this end, the lift cup will lift and effect fluid flow through the manifold conduit 25 only as required into an "as needed" situation relative to the use of the organization. The shield 31 includes shield legs 32 mounted to the housing top wall 13 in surrounding relationship relative to the exhaust grid 15, with the shield having a convex cavity 33 with a peripheral trough 34 directed peripherally about the shield within the convex cavity 33. A drain conduit 35 in fluid communication with the peripheral trough 34 directs excess condensation from the within the convex cavity 33 through the trough 34 and exteriorly of the organization by means of the drain conduit 35.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air conditioner cooling apparatus, comprising, an air conditioner housing, having a plurality of housing side walls, and a housing top wall, with a cooling condenser mounted within the air conditioner housing, and the housing top wall including an exhaust grid and a fan mounted within the housing in adjacency to the exhaust grid, and a support post, the support post including a switch member mounted to the support post, the switch member including a pivot axle, with a support rod extending from the pivot axle over the exhaust grid, with the support post having a first end secured to said pivot axle, and the support post having a second end, the second end including a lift cup, the lift cup including a convex cavity in facing relationship relative to the exhaust grid, and the lift cup oriented between an outer periphery of the exhaust grid and a medial central of the exhaust grid, and the switch member including a plunger in contiguous communication with the support rod to effect closing of the switch member upon pivoting of the support rod about the pivot axle, and a fluid control valve in electrical communication with the switch member, and a fluid inlet conduit directed into the fluid control valve, and a manifold conduit extending from said fluid control valve along a plurality of said side walls, with the housing side walls each including a side wall opening, and at least one nozzle conduit directed from the fluid inlet conduit through each of the side wall openings, each nozzle conduit including an outlet end projecting into the housing for effecting misting of said condenser upon the closing of the switch member directing fluid flow through the fluid control valve.

2. An apparatus as set forth in claim 1 including a filter housing mounted to and in fluid communication with the fluid inlet conduit, the filter housing including a filter therewithin to effect filtering of particulate from fluid directed to the manifold conduit from the filter housing through the fluid control valve.

3. An apparatus as set forth in claim 2 including a shield, the shield positioned in a spaced and facing relationship relative to the exhaust grid, with the lift cup and the support rod positioned between the shield and the exhaust grid, and the shield including a plurality of shield legs, the shield legs fixedly mounted to the housing top wall.

4. An apparatus as set forth in claim 3 wherein the shield includes a convex cavity in facing relationship relative to the exhaust grid, and a peripheral trough within the convex cavity in communication with the convex cavity, and a drain conduit in fluid communication with the peripheral trough, the drain conduit extending from said peripheral trough exteriorly of said housing.

* * * * *